United States Patent [19]

Jirusẽ

[11] 4,399,990

[45] Aug. 23, 1983

[54] UNIVERSAL SUCKER

[75] Inventor: Jaroslav Jirusẽ, Blansko, Czechoslovakia

[73] Assignee: ZVS Adamovske strojirny, Koncernovy podnik, Prague, Czechoslovakia

[21] Appl. No.: 305,988

[22] Filed: Sep. 28, 1981

[30] Foreign Application Priority Data

Oct. 15, 1980 [CS] Czechoslovakia ..... 6970-80

[51] Int. Cl.[3] ..... B65H 3/08

[52] U.S. Cl. ..... 271/90

[58] Field of Search ..... 271/90, 103, 102, 91, 271/92, 104, 105, 106, 107

[56] References Cited

U.S. PATENT DOCUMENTS 3,122,391 2/1964 Didde ..... 271/90 X 3,476,380 11/1969 Calistrat ..... 271/102

*Primary Examiner*—Richard A. Schacher

*Attorney, Agent, or Firm*—Burgess, Ryan & Wayne

[57] ABSTRACT

The invention is a universal sucker element for a paper feeder unit which comprises a support tube on which is adjustably mounted a carrier provided with a swivably mounted body having a rotatable and movable piston. The body can be adjusted so that the piston moves obliquely to the plane of the paper. The position of the body and the piston are fixed by means of simple position locking means.

4 Claims, 4 Drawing Figures

UNIVERSAL SUCKER

The invention is a universal sucker element and its arrangement in a feeder unit of a printing machine.

The feeder unit separates the individual paper sheets from the pile on the feeder board and conveys them to the transport unit. The feeder unit is equipped with pneumatic suckers which function as separating and conveying means.

The feeder units are operated so that the top paper sheet sticks to the suckers under the influence of a vacuum and is separated from the remaining sheets in the pile. The separated paper sheet is lifted by means of the suckers and air is generally blown under the lifted paper sheet through a hollow feeler. The air flow creates an air cushion on which the paper sheet is carried into the transport unit. The cycle is repeated in the operation of the printing unit. To avoid the encounter of its front edge with the rear edge of the lifted paper sheet during the feeler movement, the lifted paper sheet cannot sag. To avoid undesirable sagging of the paper sheet between the lift suckers some known devices are provided with a means for tensioning the paper sheets.

The invention is a universal sucker, the arrangement of which assures reliable separation of the individual paper sheets from a pile on the feeder board and simultaneous separation of soft and hard stock as well as even and bent paper sheets.

BACKGROUND OF THE INVENTION

One of the known sucker elements is arranged with its carrying body fixed firmly on the support tube. The sucker mechanism is located in the support body with a provision for vertical movement. The sucker does not provide for tensioning of soft bent paper sheets and in addition does not assure separation of bent paper sheets.

Another known sucker element is arranged on the support tube by means of an articulated joint which enables oblique adjustment of the sucker element in relation to the paper sheet. This sucker element has a disadvantage in that the articulated joint is complex and requires additional operator tension and detracts from operation of the feeder unit. To adjust the oblique position of the sucker element, the sucker element is removed, the articulated joint is replaced and the sucker element is remounted. The adjustment is a tedious job.

BRIEF DESCRIPTION OF THE INVENTION

The disadvantages of the prior art devices are substantially reduced by the device according to the present invention which comprises a carrier, mounted adjustably on a support tube; the carrier is provided with a body which carries a rotatably and shiftably mounted piston provided with projections which engage a groove formed in a control element arranged on the body, the control element is also provided with a tooth which meshes with at least one of the slots formed in a support piece which is fixed firmly on the carrier. The body is swively mounted on the carrier. The body can be swively mounted on the carrier by screw means provided with a compression spring which bears with its one end against a step created in the body and with its opposite end against a contact area of the screw head. The control element can be formed as a flat spring with its lower part provided with a first handle to disengage the control element so that the piston can be rotated and at its upper part, with another handle, which can be used to disengage the control element from the carrier so that the body may be swivelled in relation to the carrier. The piston carries a sucker collar which can be mounted so that the plane of the sucker collar forms an angle with the axis of the piston.

The universal sucker element of the present invention reliably separates paper sheets from a pile since the piston can be adjusted easily into the various positions to accommodate an uneven pile when the paper sheets sag. It is also possible to replace the piston and to use a piston with an oblique or horizontal working area.

Another advantage of the present invention is that the universal sucker element can be swivelled and arranged so that the piston performs an oblique vertical movement. At the instant of contacting the paper sheet, when the piston working areas are in their lower position, the sucker collars are in a mutual nearer position. After gripping the paper sheet, and during the lifting, the sucker collars move apart from each other. The moving apart tensions the paper sheet which is essential when feeding soft paper to prevent sagging.

Another advantage of the present invention is that the adjustment of the sucker into an oblique position can be done quickly. Also the sucker piston can be easily rotated or replaced. Both operations are carried out without use of any tools by manipulation of the control element. For feeding hard stock sheets which do not sag, a piston with a horizontal working area is used.

DETAILED DESCRIPTION OF A PREFERRED EMBODIMENT

Figure 1:
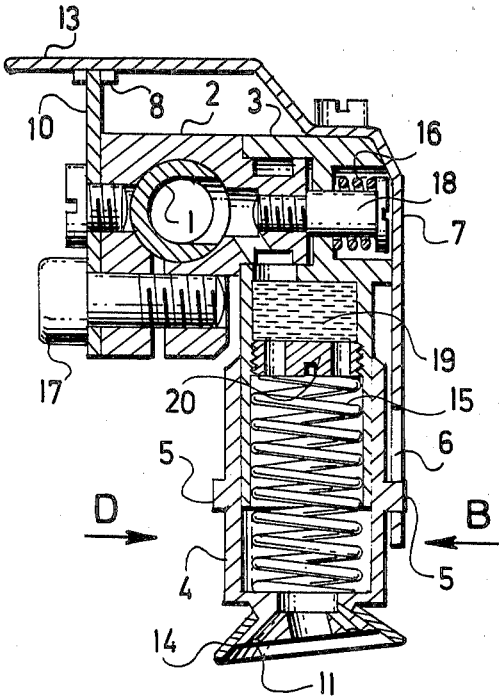
FIG. 1 is a sectional view of a device of the present invention through the plane A—A of FIG. 2.
Figure 2:
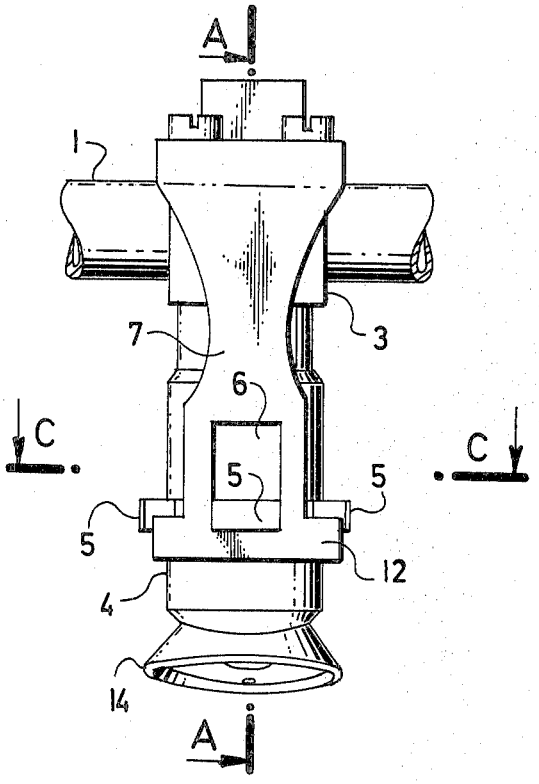
FIG. 2 is a view of the universal sucker in the direction of the arrow B of FIG. 1.
Figure 3:
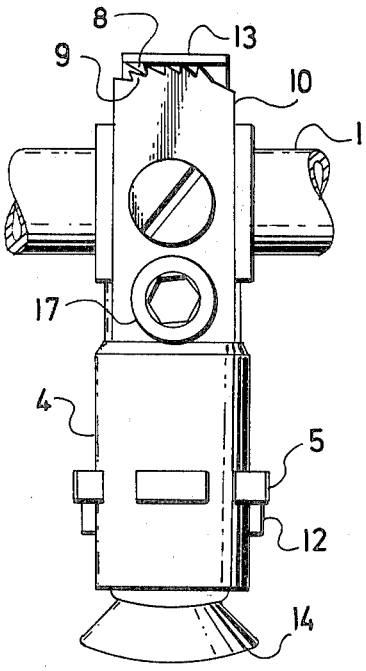
FIG. 3 is a view of the universal sucker in the direction of the arrow D of FIG. 1.
Figure 4:
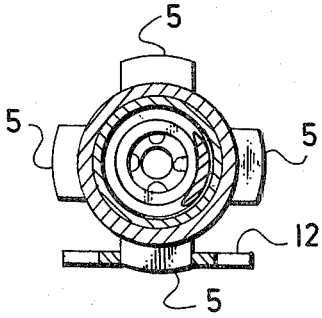
FIG. 4 is a sectional view of a device of the present invention through the plane C—C of FIG. 2.

The universal sucker of the invention comprises a support tube 1 on which is mounted a carrier 2 by means of locking screws 17. A body 3 carrying a shiftable piston 4 is swivelly mounted on the carrier 2. The piston 4 has formed thereon projections 5, one of which engages a cut-out 6 formed in a control element 7 which is mounted on the body 3. In the upper part of the control element 7 is formed a tooth which engages one of the notches 9 created in the support plate 10.

The support plate 10 is fixedly mounted on the carrier 2. The control element 7 is made of elastic material and formed into a flat spring. In the lower part of the control element 7 is formed a first handle 12 for disengaging the projections of the piston 4 from the cut-out of the control element and in the upper part of the control element 7 is formed another handle 13 for disengaging the tooth from the notches in the support piece. The working area 11 is formed in the lower part of the piston 4. The piston 4 is provided with a sucker collar 14. A spring 15 is mounted in body 3 with its one end in contact with the lower stepped part of the piston 4 and with its opposite end in contact with the lead screw 20. The body 3 is urged toward the carrier 2 by means of a compression spring 16 which is located on a lead screw 18 fixed in the carrier 2. In the body 3 is located a filter 19 fixed by means of the lead screw 20. The filter is positioned between the piston and the vacuum source to prevent paper particles from entering and clogging the vacuum system.

The universal sucker of the present invention operates as follows: the paper sheet is forced against the sucker collar 14 and the working area 11 of the piston 4 by means of vacuum. The piston 4 is lifted to an upper position by means of the vacuum action and the spring 15 is compressed. When the vacuum is broken, the spring 15 urges the piston 4 into the lower position until the projections 5 contacts the bottom of the cut-out 6 in the control element 7.

When feeding soft paper stock, the universal sucker is adjusted obliquely to the plane of the paper so that the sucker collars of a pair of pistons 4 are nearer one to another in the lower position so that during the vertical movement of the pair of pistons 4 from the lower position to the upper position, the working areas 11 move away from one another. In such a way, the paper sheets are tensioned during the feeding.

The adjustment of the universal sucker into an oblique position is carried out by lifting the handle 13 until the tooth 8 disengages from the respective notch 9. The body 3 is swivelled about the carrier 2 to the required position and the body 3 is locked in the required oblique position by releasing the lifting force on the handle 13 and permitting the tooth 8 to engage with notch 9 by the elastic pressure of the control element 7. The position of the piston 4 can be changed by means of handle 12 of control element 7 until the projection 5 is disengaged from the cut-out 6. Then the piston 4 is rotated into the required position and locked by engaging the respective projection 5 with the cut-out 6 of the control element 7. In a similar way, piston 4 can be replaced by another piston 4 having a different inclination of the working area 11. The whole universal sucker is fitted to swivel on the support tube 1 and locked in the required position by means of lock screw 17.

I claim:

1. A universal sucker for a paper feeder unit which comprises:

a support tube having adjustably mounted thereon a carrier having a support piece, on said carrier is swivelly mounted a body fitted with a shiftable cylindrical piston having an axis and a working area, said piston being provided with projections, a control element mounted on said body having means for engaging said projections and means for engaging said support piece to fix the swivel position of said body.

2. A universal sucker according to claim 1 wherein said control element has a slot means which engage with a projection on said piston which limits at least in one direction the actual movement of the piston.

3. A universal sucker according to claim 1 or 2 which further comprises:

a screw, having a screw head area, mounted on said carrier, the body, having a step swivelly mounted on the screw, a compression spring which bears with one end against the screw head and with its other end against the step in the body whereby the body is urged into contact with the carrier.

4. A universal sucker according to claim 1 or 2 wherein the control element having a lower part and an upper part, is a flat spring having a first handle provided on its lower part for disengaging the control element from the projection on the piston and a second handle on its upper part for disengaging the support piece so that the body can be swivelled about the carrier.

* * * * *